US010729605B1

(12) United States Patent
Chinake

(10) Patent No.: US 10,729,605 B1
(45) Date of Patent: Aug. 4, 2020

(54) METHODS FOR USING PATIENT-TURNING ASSEMBLIES

(71) Applicant: Sekai Chinake, Spring, TX (US)

(72) Inventor: Sekai Chinake, Spring, TX (US)

( * ) Notice: Subject to any disclaimer, the term of this patent is extended or adjusted under 35 U.S.C. 154(b) by 0 days.

(21) Appl. No.: 16/858,563

(22) Filed: Apr. 24, 2020

(51) Int. Cl.
*A61G 7/00* (2006.01)
*A61G 7/10* (2006.01)

(52) U.S. Cl.
CPC ..... *A61G 7/001* (2013.01); *A61G 7/1023* (2013.01); *A61G 7/1051* (2013.01); *A61G 7/00* (2013.01); *A61G 7/10* (2013.01)

(58) Field of Classification Search
CPC . A61G 7/00; A61G 7/001; A61G 7/10; A61G 7/1023; A61G 7/1025; A61G 7/1026; A61G 7/103; A61G 7/1051; A47G 9/02; A47G 9/0207; A47G 9/0223; A47G 9/0238; A47G 9/0246; A47G 9/0253; A47G 9/0261; A47C 27/002; A47C 31/105
USPC ... 5/81.1 T, 81.1 HS, 81.1 R, 485, 482, 632, 5/630, 621, 731
See application file for complete search history.

(56) References Cited

U.S. PATENT DOCUMENTS 2,462,780 A * 2/1949 Schiller ..... A47G 9/02 5/485
2,586,031 A * 2/1952 Hahne ..... A47G 9/02 5/485
2,596,547 A * 5/1952 Guest ..... A47G 9/0207 5/502
3,148,388 A * 9/1964 Espersen ..... A47G 9/02 5/485
3,638,251 A * 2/1972 Weiss ..... A47G 9/02 5/485
3,800,340 A * 4/1974 Valentine ..... A47G 9/02 5/485
3,924,282 A * 12/1975 Bond ..... A47C 20/027 5/632
4,607,402 A * 8/1986 Pollard ..... A47C 21/08 5/425
4,675,925 A 6/1987 Littleton
4,754,509 A * 7/1988 Pollard ..... A47C 21/08 5/425
4,754,513 A * 7/1988 Rinz ..... A47G 9/0253 5/485

(Continued)

FOREIGN PATENT DOCUMENTS

TW M535559 U 1/2017
WO WO2012170934 A2 12/2012

OTHER PUBLICATIONS

Kieran Leong et al, A Novel Method for Proning Patients with Acute Respiratory Distress Syndrome, University of Minnesota, Medical Devices Center.

*Primary Examiner* — Robert G Santos
(74) *Attorney, Agent, or Firm* — Elliott & Polasek, PLLC; Douglas H. Elliott; Nathan Q. Huynh

(57) ABSTRACT

Disclosed herein are patient-turning assemblies including a patient-turning assembly for turning a patient, which patient-turning assembly may include: a sling having: a first sling portion having a handle; and a second sling portion extending from the first sling portion; a sleeve fixedly coupled to the second sling portion; a channel disposed between the sleeve and the second sling portion; and a cushion capable of either ingress into or egress from the channel, or both.

20 Claims, 11 Drawing Sheets

(56) References Cited

U.S. PATENT DOCUMENTS 4,873,734 A * 10/1989 Pollard ..... A47C 21/08 5/425
5,056,533 A 10/1991 Solano
5,099,530 A * 3/1992 Scott ..... A47G 9/02 5/419
5,168,590 A * 12/1992 O'Sullivan ..... A47G 9/0253 5/421
5,195,197 A * 3/1993 Gutierrez ..... A47C 27/002 5/482
5,274,862 A 1/1994 Palmer
5,706,535 A * 1/1998 Takashima ..... A47G 9/007 5/485
5,918,333 A * 7/1999 Takashima ..... A47G 9/007 5/636
6,237,171 B1 * 5/2001 Allen ..... A47G 9/0207 5/482
6,243,896 B1 * 6/2001 Osuna ..... A47G 9/0261 5/502
6,349,432 B1 2/2002 Scordato et al.
6,415,466 B1 * 7/2002 Laiso ..... A47G 9/02 5/482
7,584,515 B2 * 9/2009 Jones ..... A47G 9/02 2/69.5
7,832,034 B2 * 11/2010 Liu ..... A47G 9/10 5/636
7,904,977 B1 * 3/2011 Singh ..... A47C 21/08 5/424
7,971,292 B1 * 7/2011 Sithian ..... A47C 20/021 5/485
8,127,385 B1 3/2012 Goutevenier
8,176,585 B1 5/2012 Isham
8,661,580 B2 * 3/2014 Giap ..... A61G 7/1023 128/870
8,789,533 B2 * 7/2014 Steffens ..... A61G 7/001 128/845
8,850,634 B2 * 10/2014 Ponsi ..... A61G 7/001 5/633
8,984,681 B2 * 3/2015 Ponsi ..... A61G 7/001 128/845
9,414,977 B2 * 8/2016 Ponsi ..... A61G 7/001
9,504,621 B2 * 11/2016 Purdy ..... A61G 7/001
9,693,920 B2 * 7/2017 Fowler ..... A61G 7/057
9,820,902 B2 * 11/2017 Ponsi ..... A61G 7/001
9,820,903 B2 * 11/2017 Steffens ..... A61G 7/001
9,833,371 B2 * 12/2017 Purdy ..... A61G 7/1021
9,849,053 B2 * 12/2017 Rigoni ..... A61G 7/05715
9,861,544 B2 * 1/2018 Rigoni ..... A61G 7/05715
10,064,773 B2 * 9/2018 Rigoni ..... A61G 1/01
10,349,752 B2 7/2019 Melcher et al.
10,363,185 B2 * 7/2019 Purdy ..... A61G 7/001
10,398,614 B2 * 9/2019 Rigoni ..... A61G 7/001
10,448,746 B2 * 10/2019 Galloway ..... A47G 9/02
10,561,522 B2 * 2/2020 Giap ..... A61M 16/0003
10,561,556 B2 * 2/2020 Rigoni ..... A61G 7/05769
10,588,800 B2 * 3/2020 Fletcher ..... A61G 7/001
10,596,051 B2 * 3/2020 Purdy ..... A61G 7/1025
2002/0095726 A1 * 7/2002 Michetti ..... A47G 9/007 5/482
2009/0056017 A1 * 3/2009 Jones ..... A47G 9/02 5/485
2010/0077551 A1 * 4/2010 Liu ..... A47G 9/10 5/636
2011/0296609 A1 * 12/2011 Giap ..... A61G 7/1092 5/88.1
2012/0186012 A1 * 7/2012 Ponsi ..... A61G 7/1026 5/81.1 R
2012/0186013 A1 * 7/2012 Ponsi ..... A61G 7/0525 5/81.1 R
2012/0186587 A1 * 7/2012 Steffens ..... A61G 7/1026 128/845
2012/0311781 A1 * 12/2012 Purdy ..... A61G 7/05792 5/81.1 T
2013/0104907 A1 * 5/2013 Giap ..... A61G 7/1023 128/845
2013/0152950 A1 6/2013 Giap
2013/0198950 A1 * 8/2013 Purdy ..... A61G 7/1021 5/81.1 T
2013/0205495 A1 * 8/2013 Ponsi ..... A61G 7/10 5/81.1 HS
2014/0304918 A1 * 10/2014 Steffens ..... A61G 7/001 5/617
2015/0143628 A1 * 5/2015 Fowler ..... A61G 7/1073 5/81.1 T
2016/0008194 A1 * 1/2016 Ponsi ..... A61G 7/001 5/81.1 HS
2016/0067126 A1 * 3/2016 Purdy ..... A61G 7/1025 5/655.3
2017/0049646 A1 * 2/2017 Rigoni ..... A61G 7/05769
2017/0049647 A1 * 2/2017 Rigoni ..... A61G 7/05715
2017/0049648 A1 2/2017 Kennedy et al.
2017/0112655 A1 * 4/2017 Giap ..... A61F 5/3761
2017/0119608 A1 * 5/2017 Rigoni ..... A61G 7/001
2017/0151112 A1 6/2017 Fletcher et al.
2018/0028381 A1 2/2018 Purdy
2018/0049935 A1 * 2/2018 Rigoni ..... F16K 15/20
2018/0311097 A1 11/2018 Rodzewicz et al.
2018/0352967 A1 * 12/2018 Galloway ..... A47C 20/023
2018/0369048 A1 * 12/2018 Rigoni ..... A61G 7/05769
2019/0060147 A1 2/2019 Montgomery

* cited by examiner

METHODS FOR USING PATIENT-TURNING ASSEMBLIES

BACKGROUND

1. Field of Inventions

The field of this application and any resulting patent is patient-turning assemblies and methods for using patient-turning assemblies.

2. Description of Related Art

Various patient-turning assemblies and methods for using patient-turning assemblies have been proposed and utilized, including those disclosed in some of the patents and/or publications on the front of this patent. However, those methods and assemblies lack the combination of steps and/or features of the methods and/or assemblies disclosed herein. Furthermore, it is contemplated that the methods and/or assemblies disclosed herein solve many of the problems that prior art methods and assemblies have failed to solve. A need therefore exists for improved patient-turning assemblies.

SUMMARY

Disclosed herein are methods of turning a patient that may include: providing a person-turning assembly that may include: a flexible sling that may have: a first sling portion with a first upper surface; and a second sling portion with a second upper surface; and a flexible sleeve coupled to at least a portion of the second upper surface; sliding a cushion between the second upper surface and the sleeve; laying the person on the first sling portion; disposing the second sling portion over the person; pulling the handle across the person; and turning the person onto the cushion after pulling the handle.

Additionally disclosed herein are methods of turning a patient that may include: providing a patient-turning assembly that may include: a flexible sling having a sling upper surface, a top edge, a bottom edge, and a side edge; and either one flexible sleeve or multiple parallel flexible sleeves, each flexible sleeve may have: (a) an interior surface and an exterior surface; (b) a first edge coupled to the sling upper surface; (c) a second edge coupled to the sling upper surface, wherein the first edge and the second edge are spaced apart and parallel to one another; and (d) an opening extending between the first edge and the second edge such that a cushion can be inserted through the opening and into the interior of each flexible sleeve, wherein: (i) the first and second edges of the one flexible sleeve are parallel to the side edge of the flexible sling; and (ii) the first and second edges of each of the multiple flexible sleeves are parallel to the bottom edge or the top edge of the flexible sling and each of the multiple flexible sleeves are separated by a gap.

Also disclosed herein are methods of turning a patient that may include: providing a person-turning assembly that may include: a sling that may have: a first sling portion; and a second sling portion extending from the first sling portion; a sleeve coupled to the second sling portion; a cushion; and a strap having: a first strap portion coupled to the first sling portion; and a second strap portion; disposing the cushion between the sleeve and the second sling portion; laying the person on the first sling portion; disposing the second sling portion over the person; disposing a portion of the first strap portion over the person; disposing a portion of the second strap portion under the person; pulling the second strap portion to abut an inner surface of the second strap portion against the person; and turning the person onto the cushion while pulling the first strap portion in the first direction.

Further disclosed herein are patient-turning assemblies that may include: a sling having: a first sling portion having a handle; and a second sling portion extending from the first sling portion; a sleeve fixedly coupled to the second sling portion; a channel disposed between the sleeve and the second sling portion; and a cushion capable of either ingress into or egress from the channel, or both.

Disclosed herein are patient-turning assemblies that may include: a sling having: a first sling portion; and a second sling portion extending from the first sling portion; a cushion capable of being fixedly coupled to the second sling portion; and a strap that may have: a length longer than a width of the sling; a first strap portion removably coupled to the first sling portion; and a second strap portion coupled to a lower surface of the first sling portion, wherein when the person is disposed on the first sling portion and when the second strap portion is pulled across the person, an inner surface of the second strap portion is abutted against a lower surface of the first sling portion.

DETAILED DESCRIPTION

1. Introduction

Figure 1A:
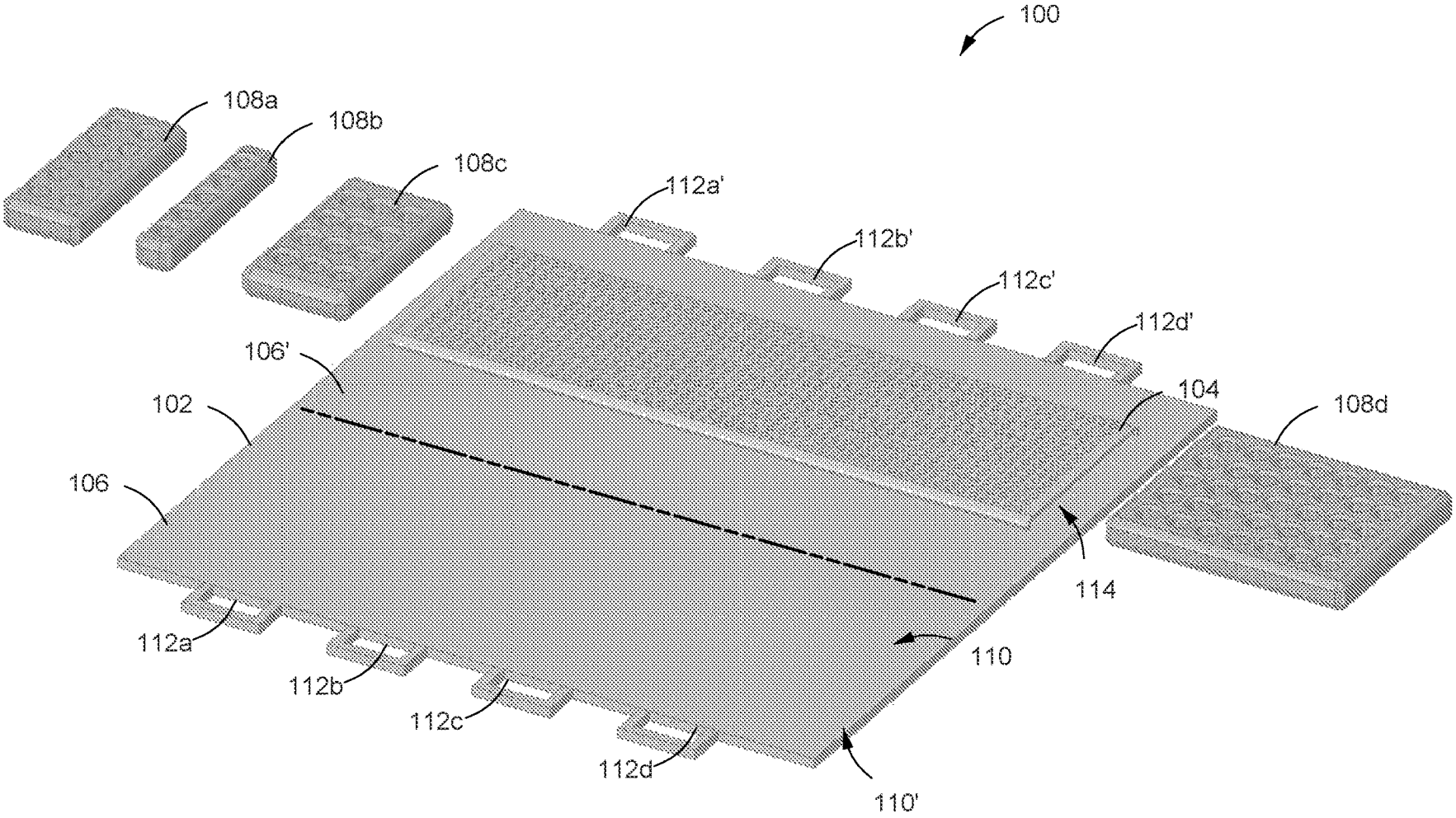
FIG. 1A illustrates a perspective view of a patient-turning assembly that includes a sling and a flexible sleeve coupled to an upper surface of the sling, and also shows cushions before they are placed inside the flexible sleeve.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "abut against" as used herein as a verb is defined as position adjacent to and either physically touch or press against, directly or indirectly. After any abutting takes place with one object relative to another object, the objects may be fully or partially "abutted." A first object may be abutted against a second object such that the second object is limited from moving in a direction of the first object. For example, a portion of a cushion may be abutted against a surface of a sleeve and/or a sling.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object including a structure such as a sling and/or a sleeve. For example, an aperture may be a three-dimensional opening that begins on one side of a solid object and ends on the other side of the object, e.g., the space inside a sleeve, for receiving a cushion. An aperture may alternatively be an opening that does not pass entirely through an object, but only partially passes through, e.g., as a groove. An aperture can be an opening in an object that is completely circumscribed, defined, or delimited by the object itself. Alternatively, an aperture can be an opening formed when one object is combined with one or more other objects or assemblies. An aperture may receive an object, e.g., cushion.

The term "assembly" as used herein is defined as any set of components that have been fully or partially assembled together. A group of assemblies may be coupled to form a larger assembly.

The term "axial opening" as used herein is defined as any opening in a solid object in which the opening extends along a central axis of the object.

The term "coupled" as used herein is defined as directly or indirectly connected or attached. A first object may be coupled to a second object such that the first object is positioned at a specific location and orientation with respect to the second object. For example, a motor may be coupled to a cutter assembly. A first object may be either permanently, removably, slidably, and/or rotatably coupled to a second object. Two objects are "permanently coupled," if once they are coupled, the two objects, in some cases, cannot be separated. For example, a sleeve may be sewn to a sling and remain attached to the sling. Two objects may be "removably coupled" to each other via threads, tape, latches, hooks, fasteners, locks, clips, clamps, knots, and/or surface-to-surface contact. For example, a strap and a sling may be removably coupled to each other such that the strap may then be uncoupled and removed from the sling. Two objects may be "slidably coupled" where an inner aperture of one object is capable of receiving a second object. For example, a cushion disposed between a portion of a sling and a sleeve may be slidably coupled to the sling and the sleeve.

The term "coupling means" as used herein is defined as any structure disclosed herein, including any disclosed assembly, capable of performing the function of coupling objects, including cloth structures or other apparel structures, together, wherein such as canvas or cloth structures may be made from natural materials such as cotton, linen, etc., but may also be made from artificial materials such as polypropylene. Examples of cloth structures include structures made of natural textiles such as fabric, cotton, and linen, and also include those made from artificial materials such as polypropylene, plastics, polyester, Kevlar, and leather. A coupling means may include a hook, button, magnet, zipper tape, pin, thread, tape, latch, fastener, lock, clip, clamp, clasp, and/or knot. A coupling means may be a hook sewn onto a strap. A coupling means may have a portion removably coupled to a handle.

The term "cushion" as used herein as noun is defined as a structure that is capable of deforming when a person lies on or leans against the structure, and can be configured, sized, and/or shaped to support a portion of a person's body. Examples of cushions include pillows, memory foam, and inflatable bladders. A cushion may be soft and/or pliable. A cushion may conform to contours of a person's body. A cushion may be coupled to and may be inflated and/or deflated by a sequential circulation device (SCD). An example of a sequential circulation device that can be used for inflating and/or deflating any cushion described herein can be found in U.S. Pat. No. 4,091,804, in paragraphs starting at column 3 sentence 27 through column 4 sentence 27 of that publication, and the contents of those paragraphs are also incorporated herein by reference.

The terms "first" and "second" as used herein merely differentiate two or more things or actions, and do not signify anything else, including order of importance, sequence, etc.

The term "perpendicular" as used herein is defined as at an angle ranging from 85° or 88 to 92° or 95°. Two structures that are perpendicular to each other may be orthogonal and/or tangential to each other.

The term "providing" as used herein is defined as making available, furnishing, supplying, equipping, or causing to be placed in position.

The term "sleeve" as used herein is defined as any flexible structure with an outer surface, an inner surface, and at least two edges that are spaced apart from one another and are coupled to a surface of a sling. A sleeve has an interior portion capable of receiving a cushion and at least one opening through which a cushion can be inserted. A sleeve can be made of any number of materials, including canvas, or an artificial elastic mesh material. It may comprise cloth and be constructed from any one of various textiles, e.g., fabric, man-made and/or natural fibers, cotton, linen, plastic, polyester, vinyl, Kevlar, and/or leather. A sleeve may be elastic.

The term "sling" as used herein is defined as any flat, flexible structure having edges, an upper surface, a lower surface, which is preferably made of canvas or cloth, and is preferably sized, shaped, and configured to have a portion for a person to lay on, e.g., on a surface of the sling. A sling may comprise canvas or cloth and be constructed from any one of various materials, e.g., fabric, man-made and/or natural fibers, cotton, linen, plastic, polyester, vinyl, Kevlar, and/or leather. A sling may have multiple layers coupled, e.g., sewn or laminated, together. A sling may be dimensioned to accommodate patients of varying sizes and ages, e.g., minor, adult, elderly, or obese patients. A patient may be any human being needing medical attention. Preferably, a sling is 2 m by 2 m, e.g., about 6.5 ft by 6.5 ft. A sling may be triangular, square, rectangular, pentagonal, hexagonal, octagonal, or circular. A sling is preferably rectangular and planar, i.e., flat on both the upper and lower surfaces. A sling may have a lower surface and an upper surface, where the upper surface is adjacent and/or in physical contact with a person lying on sling. A sling may have a sleeve coupled thereto so that a cushion may be inserted between the sling and the sleeve.

The term "strap" as used herein is defined as a flexible structure that has a long side and at least one short side and is capable of forming a loop around a sling. A strap may be rectangular in cross-section. A strap may be continuous, or it may have two ends. A strap may comprise canvas or cloth and be constructed from any one of various materials, e.g., fabric, cotton, linen, plastic, polyester, vinyl, Kevlar, and/or leather. A strap may be folded into two or more adjacent portions or segments. Certain straps disclosed herein may have segments folded into plies that are sutured together. A strap may have a hook extending therefrom.

The term "surface" as used herein is defined as any face and/or boundary of a structure. A surface may also refer to that flat or substantially flat area that is extended across a flat structure which may, for example, be part of a plate and an arm. A surface may also refer to any curved area that extends circumferentially around a cylindrical structure or object which may, for example, be part of an arm and/or a rib. A surface may have irregular contours. A surface may be formed from coupled components, e.g. a sling, a strap, a sleeve, a cushion, and/or a handle. Coupled components may form irregular surfaces. A plurality of surfaces may be connected to form a polygonal cross-section. An example of a polygonal cross-section may be triangular, square, rectangular, pentagonal, hexagonal, or octagonal.

The term "unitary" as used herein defined as having the form of a single unit.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" or "top" identifies any object or part of a particular object that is farther away from the center of the earth than some other object or part of that particular object, when the objects are positioned in their intended useful positions. The term "lower" or "bottom" identifies any object or part of a particular object that is closer to the center of the earth than some other object or part of that particular object, when the objects are positioned in their intended useful positions.

3. Certain Specific Embodiments

Disclosed herein are methods of turning a patient that may include: providing a person-turning assembly that may include: a flexible sling that may have: a first sling portion with a first upper surface; and a second sling portion with a second upper surface; and a flexible sleeve coupled to at least a portion of the second upper surface; sliding a cushion between the second upper surface and the sleeve; laying the person on the first sling portion; disposing the second sling portion over the person; pulling the handle across the person; and turning the person onto the cushion after pulling the handle.

Additionally disclosed herein are methods of turning a patient that may include: providing a patient-turning assembly that may include: a flexible sling having a sling upper surface, a top edge, a bottom edge, and a side edge; and either one flexible sleeve or multiple parallel flexible sleeves, each flexible sleeve may have: (a) an interior surface and an exterior surface; (b) a first edge coupled to the sling upper surface; (c) a second edge coupled to the sling upper surface, wherein the first edge and the second edge are spaced apart and parallel to one another; and (d) an opening extending between the first edge and the second edge such that a cushion can be inserted through the opening and into the interior of each flexible sleeve, wherein: (i) the first and second edges of the one flexible sleeve are parallel to the side edge of the flexible sling; and (ii) the first and second edges of each of the multiple flexible sleeves are parallel to the bottom edge or the top edge of the flexible sling and each of the multiple flexible sleeves are separated by a gap.

Also disclosed herein are methods of turning a patient that may include: providing a person-turning assembly that may include: a sling that may have: a first sling portion; and a second sling portion extending from the first sling portion; a sleeve coupled to the second sling portion; a cushion; and a strap having: a first strap portion coupled to the first sling portion; and a second strap portion; disposing the cushion between the sleeve and the second sling portion; laying the person on the first sling portion; disposing the second sling portion over the person; disposing a portion of the first strap portion over the person; disposing a portion of the second strap portion under the person; pulling the second strap portion to abut an inner surface of the second strap portion against the person; and turning the person onto the cushion while pulling the first strap portion in the first direction.

Further disclosed herein are patient-turning assemblies that may include: a sling having: a first sling portion having a handle; and a second sling portion extending from the first sling portion; a sleeve fixedly coupled to the second sling portion; a channel disposed between the sleeve and the second sling portion; and a cushion capable of either ingress into or egress from the channel, or both.

Disclosed herein are patient-turning assemblies that may include: a sling having: a first sling portion; and a second sling portion extending from the first sling portion; a cushion capable of being fixedly coupled to the second sling portion; and a strap that may have: a length longer than a width of the sling; a first strap portion removably coupled to the first sling portion; and a second strap portion coupled to a lower surface of the first sling portion, wherein when the person is disposed on the first sling portion and when the second strap portion is pulled across the person, an inner surface of the second strap portion is abutted against a lower surface of the first sling portion.

In any one of the methods or assemblies disclosed herein, the flexible sleeve may be fixedly attached to the second sling portion and may have an interior portion and at least one opening configured to receive a cushion.

In any one of the methods or assemblies disclosed herein, the flexible sleeve may have one or more ends that are open.

In any one of the methods or assemblies disclosed herein, the flexible sleeve may have an axial opening configured to receive a cushion.

In any one of the methods or assemblies disclosed herein, the sleeve may have a side opening and the cushion may be capable of ingress into the side opening.

In any one of the methods or assemblies disclosed herein, at least one of the sleeves may have a maximum length greater than a maximum width of the second sling portion.

In any one of the methods or assemblies disclosed herein, the sleeve may include an elastic material.

In any one of the methods or assemblies disclosed herein, the sleeve may include a mesh material.

In any one of the methods or assemblies disclosed herein, the sleeve may have at least one side that extends parallel to the longest side of the second sling portion.

In any one of the methods or assemblies disclosed herein, the sleeve may have an upper portion with an outer surface and an inner surface, and a cushion may be capable of being disposed between at least part of the second upper surface of the second sling portion and the inner surface of the at least one of the sleeve.

In any one of the methods or assemblies disclosed herein, the cushion may be capable of egress from between the upper surface and the sleeve after turning the person onto the cushion.

In any one of the methods or assemblies disclosed herein, the strap may be capable of encircling the sling while the person is disposed on the first sling portion.

In any one of the methods or assemblies disclosed herein, the first sling portion may have a handle capable of being coupled to the first strap portion.

In any one of the methods or assemblies disclosed herein, the strap may have a portion coupled to a lower surface of the sling.

In any one of the methods or assemblies disclosed herein, a portion of the strap may be coupled to a lower surface of the second sling portion.

In any one of the assemblies disclosed herein, a portion of the strap may be coupled to a lower surface of the first sling portion.

In any one of the methods or assemblies disclosed herein, the sling upper surface may include: a first upper surface having a first top edge, a first bottom edge, and a first side edge, wherein the maximum distance from the first top edge to the first bottom edge may define the length of the first upper surface; and a second upper surface having a second top edge, a second bottom edge, and a second side edge, wherein the maximum distance from the second top edge to the second bottom edge may define the length of the second upper surface, and wherein: the second upper surface adjoins the first upper surface along a dividing line that may be shared by both the first upper surface and the second upper surface; the maximum distance from the first side edge to the dividing line defines the width of the first upper surface, the maximum distance from the second side edge to the dividing line defines the width of the second upper surface; and wherein the width of the first upper surface and the width of the second upper surface may be the same.

In any one of the methods or assemblies disclosed herein, the one or more flexible sleeves may be coupled to the first upper surface of the sling such that both the first edge of the flexible sleeve and the second edge of the flexible sleeve are coupled to the first upper surface and are parallel to the first side edge of the sling upper surface, or may be parallel to the second side edge of the sling upper surface, or may be parallel to both the first side edge and the second side edge of the sling upper surface.

In any one of the methods or assemblies disclosed herein, the one or more flexible sleeves may be coupled to the first upper surface of the sling such that both the first edge of the flexible sleeve and the second edge of the flexible sleeve may be coupled to the first upper surface and are perpendicular to the first side edge of the sling upper surface, or may be perpendicular to the second side edge of the sling upper surface, or may be perpendicular to both the first side edge and the second side edge of the sling upper surface.

Any one of the assemblies disclosed herein may further include two or more flexible sleeves each having a first edge and a second edge, wherein each of the two or more flexible sleeves may be coupled to the first upper surface of the sling such that both the first edge of each flexible sleeve and the second edge of each flexible sleeve may be coupled to the first upper surface and are parallel to the first side edge of the sling upper surface, or may be parallel to the second side edge of the sling upper surface, or may be parallel to both the first side edge and the second side edge of the sling upper surface.

Any one of the methods or assemblies disclosed herein may further include two or more flexible sleeves each having a first edge and a second edge, wherein each of the two or more flexible sleeves may be coupled to at least a portion of the first and second upper surfaces of the sling such that both the first edge of each flexible sleeve and the second edge of each flexible sleeve are coupled to the first and second upper surfaces and may be perpendicular to the first side edge of the sling upper surface, or are perpendicular to the second side edge of the sling upper surface, or may be perpendicular to both the first side edge and the second side edge of the sling upper surface.

Any one of the methods disclosed herein may further include pulling a second strap portion of the second strap to abut an inner surface of the second strap portion against the person.

In any one of the methods or assemblies disclosed herein, the sleeve may include a portion that is water-resistant.

In any one of the methods or assemblies disclosed herein, the sleeve may have two openings on opposite ends of the sleeve.

In any one of the methods or assemblies disclosed herein, the one or more sleeves may have at least one side that extends parallel to the longest side of the second sling portion.

Any one of the methods or assemblies disclosed herein may further include a strap that capable of encircling the sling while a person is disposed on the sling.

In any one of the methods or assemblies disclosed herein, the strap may have a portion coupled to a lower surface of the sling.

Any one of the methods or assemblies disclosed herein may further include a first strap portion wherein the sling may have a handle capable of being coupled to the first strap portion.

In any one of the methods or assemblies disclosed herein, the first strap portion may include a hook capable of being coupled to the first sling portion.

In any one of the methods or assemblies disclosed herein, the first strap portion may include a hook coupled to an edge of the first sling portion.

In any one of the methods or assemblies disclosed herein, the sling may have second sling portion with a lower surface and wherein a portion of the strap may be coupled to the lower surface of the second sling portion.

Any one of the methods or assemblies disclosed herein may further include one or more sleeves, wherein each of the one or more sleeves may have an outer surface and an inner surface, and may additionally include a cushion capable of being disposed between at least part of the second upper surface of the second sling portion and the inner surface of the at least one of the one or more sleeves.

4. Specific Embodiments in the Drawings

The drawings presented herein are for illustrative purposes only and do not limit the scope of the disclosure. Rather, the drawings are intended to help enable one having ordinary skill in the art to make and use the assemblies disclosed herein.

This section addresses specific versions of patient-turning assemblies shown in the drawings, which relate to assemblies, elements and parts that can be part of a patient-turning assembly. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Figure 1B:
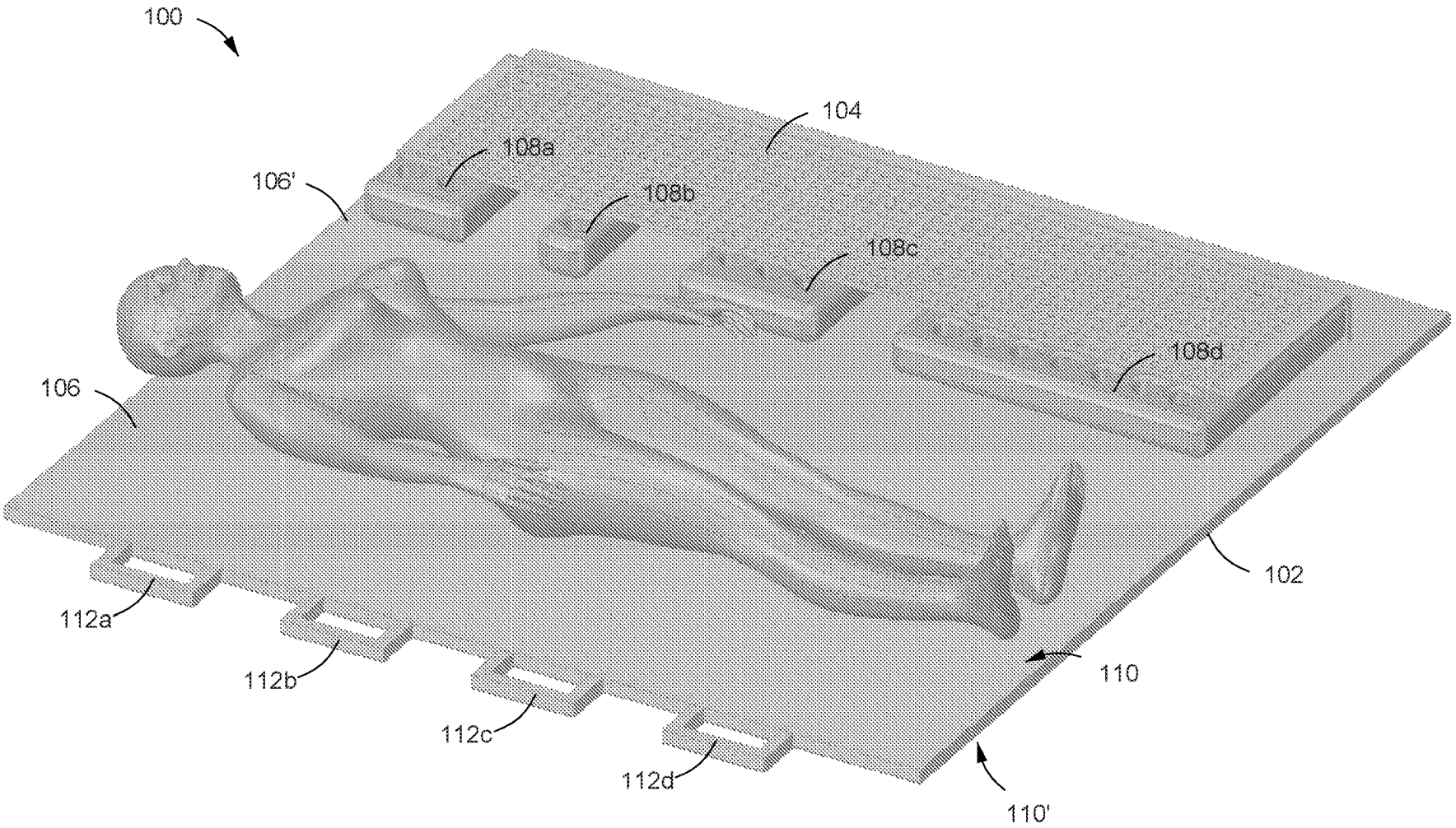
FIG. 1B illustrates a perspective view of a patient-turning assembly showing cushions disposed in the interior of a sleeve which is shown as a partially cut-a-way view to better show the cushions therein.

FIG. 1A illustrates a perspective view of a patient-turning assembly 100 having a sleeve 104 coupled to a second sling portion 106' of a sling 102, in which the sleeve 104 defines an axial opening to receive a cushion. FIG. 1B illustrates the patient-turning assembly 100 of FIG. 1A having cushions 108*a-d* disposed between the sling 102 and the sleeve 104, in which the sleeve 104 has a portion removed to better show the cushions 108*a-d* therein.

Referring to FIGS. 1A-B, a patient-turning assembly 100 includes a sling 102 and a sleeve 104. The sling 102 has an upper surface 110 and a lower surface 110'. The sling 102 is planar, e.g., flat. The sling 102 may be configured, sized, and/or shaped to have a person fit within the border of the sling 102, when the person lays on the sling 102. The sling 102 is rectangular and/or square. In at least one specific embodiment, the sling 102 is 2 m by 2 m, e.g., about 6.5 ft by 6.5 ft.

The sling 102 is foldable at the dashed central axis line. Accordingly, the sling 102 is divided into two portions: a first sling portion 106 and a second sling portion 106'. Preferably, the sling portions 106, 106' are halves of the sling 102. In other words, the sling 102 is bilaterally symmetrical along the central axis line. Thus, each sling portion 106 has a length of 2 m and a width of 1 m.

Sling handles 112*a-d* are coupled, e.g., sewn, to a length-wise edge of the first sling portion 106. Sling handles 112*a'*-d' are coupled, e.g., sewn, to a length-wise edge the second sling portion 106'. Additionally, sling handles 112*a"*-112*d"* are coupled, e.g., sewn, to the lower surface of the sling 102 along the central axis line (see FIG. 3D).

The upper surface of the second sling portion 106' has the sleeve 104 coupled, e.g., sewn, thereto. The sleeve 104 has two long sides and two short sides. The long sides are parallel to the central axis line of the sling 102. Therefore, the sleeve 104 is said to be "coupled axially" to the second sling portion 106'.

The long sides are permanently coupled to the second sling portion 106'. Accordingly, a space 114 is defined between the sleeve 104 and the second sling portion 106'.

Additionally, the short sides are left uncouple from the second sling portion 106'. Thus, the sleeve 104 is open-ended at the short sides. One or more cushions 108*a-d* may be inserted into the space 114 through either of the open ends. Accordingly, the open ends are said to provide "axial ingress" into and/or "axial egress" of the cushions 108*a-d* between the sling 102 and the sleeve 104.

The cushions 108*a-d* may have varying lengths, widths, and/or thicknesses. Accordingly, the cushions 108*a-d* may be disposed at different locations between the sleeve 104 and the sling 102 to accommodate patients of different heights and/or sizes. Moreover, the cushions 108*a-d* may be positioned spaced apart between the sleeve 104 and the sling 102 to rest certain parts of a patient's body thereon. Friction between inner surfaces of the sleeve 104 and the cushions 108-*d* and friction between the upper surface of the sling 102 and the cushions 104*a-d* would, in some cases, hold the cushions 104*a-d* in place, e.g., inhibit movement of the cushions 104*a*-de104 and/or sling 102.

Preferably, when multiple cushions are used with any of the assemblies disclosed or claimed herein, at least two and even more preferably all of the multiple cushions have different lengths from one another, as illustrated in the drawings, when "length" is defined to refer to the distance from the edge of the cushion closest to the patient's feet to the edge of the cushion closest to the patient's head. Also, in certain embodiments (not shown), the cushions are sized smaller than the interior space of the sleeves, e.g., there is sufficient space between the outer edges of each cushion and the inner edges of the sleeves so that an assembly may include different cushions can be used with a single arrangement of multiple sleeves depending on the dimensions and physiology of the patient, e.g., depending on whether the person is tall or short, obese or skinny, adult or child, etc.

Figure 2A:
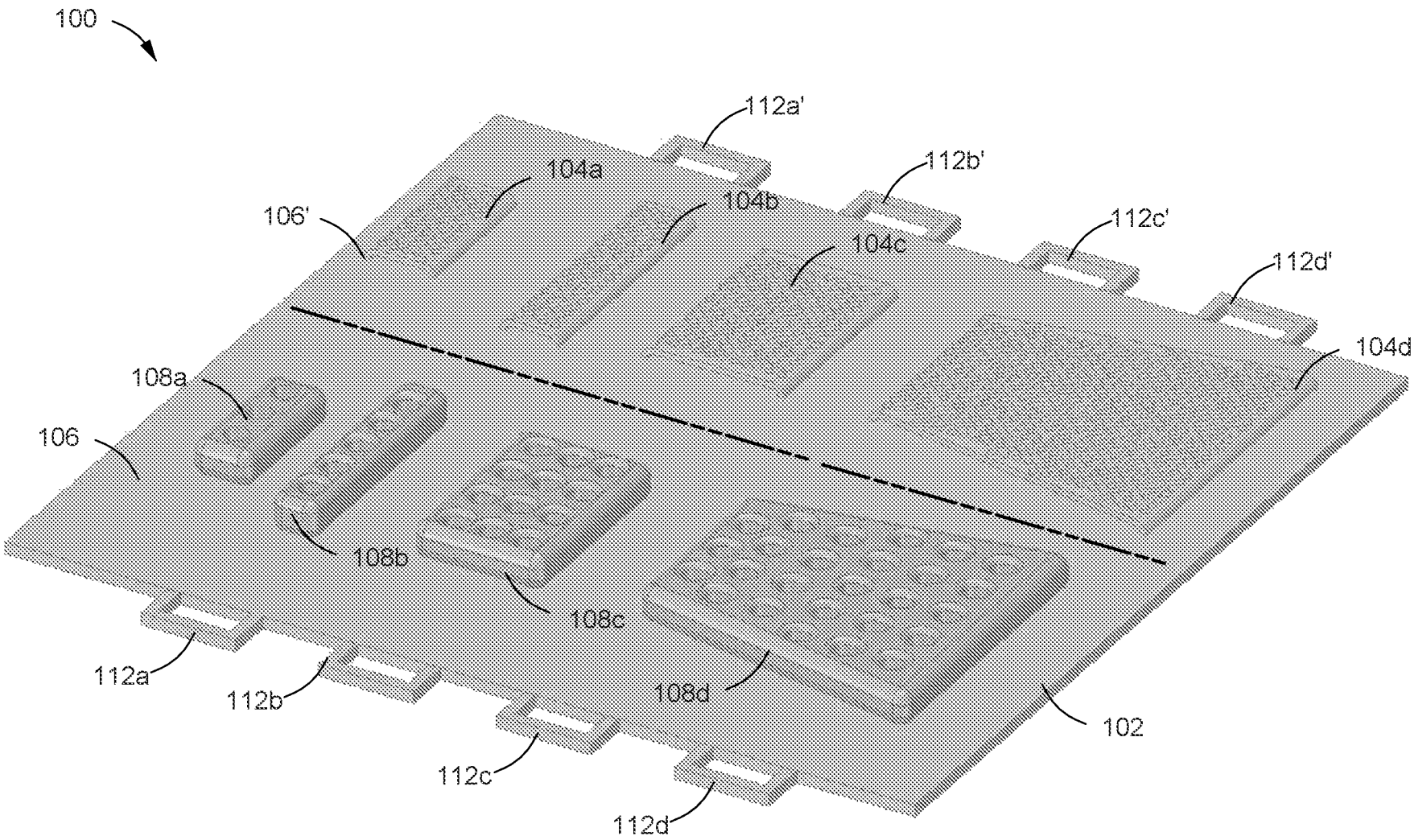
FIG. 2A illustrates a perspective view of a patient-turning assembly having four separate sleeves coupled to a second sling portion of a sling, in which the sleeves are spaced apart.
Figure 2B:
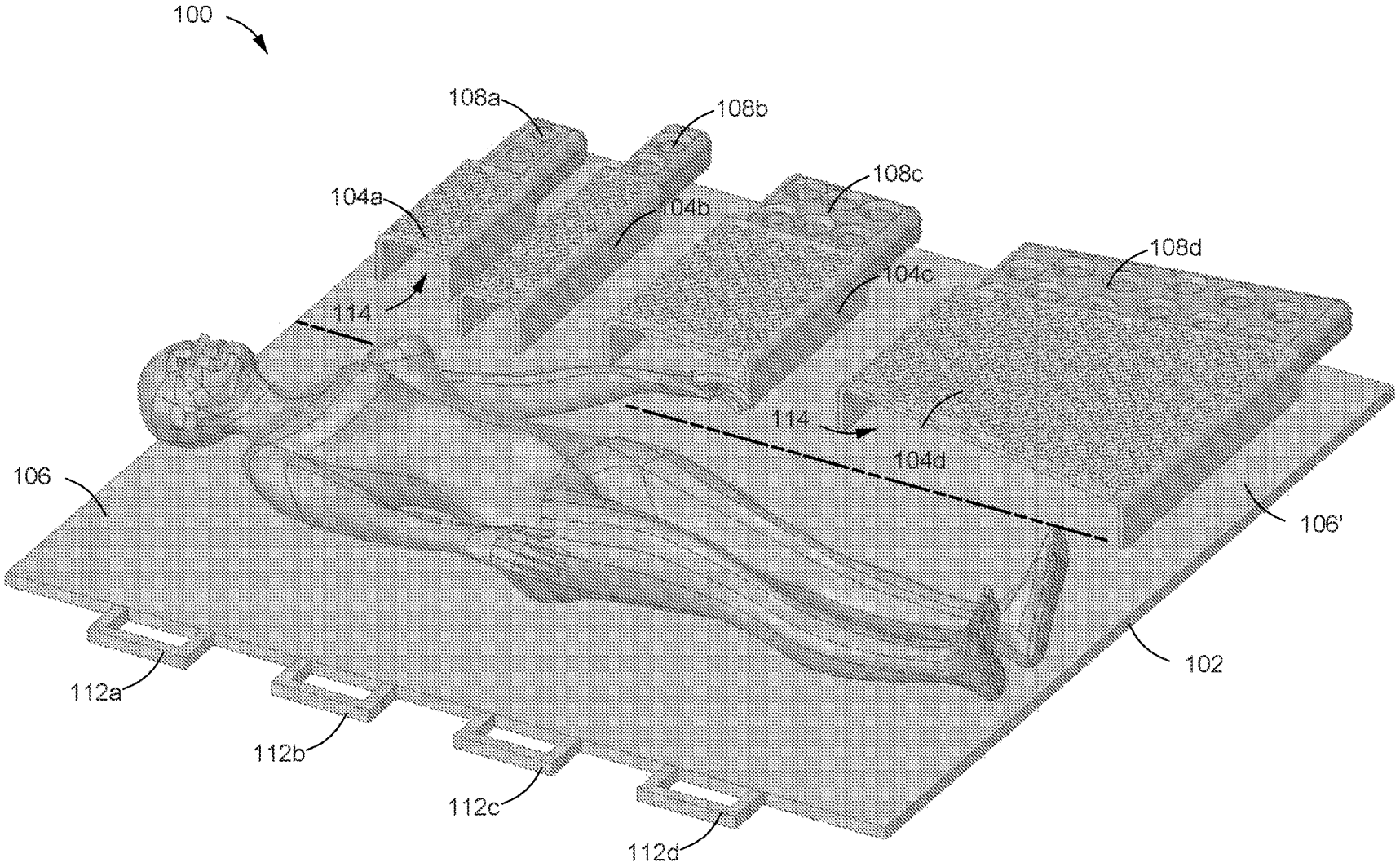
FIG. 2B illustrates the patient-turning assembly of FIG. 2A in which a cushion is disposed in the interior of each sleeve and a patient is lying in a supine position on the surface of the sling.

FIG. 2A illustrates a perspective view of a patient-turning assembly 100 having sleeves 104*a-d* coupled to a second sling portion 106' of a sling 102, in which the sleeves 104*a-d* are spaced apart. FIG. 2B illustrates the patient-turning assembly 100 of FIG. 2A having a cushion 108 disposed between each sleeve 104 and the sling 102.

Referring to FIGS. 2A-B, a patient-turning assembly 100 includes a sling 102 and a sleeve 104*a-d*. The sling 102 has an upper surface 110 and a lower surface 110'. The sling 102 is planar, e.g., flat. The sling 102 may be configured, sized, and/or shaped to have a person fit within the border of the sling 102, when the person lays on the sling. The sling 102 is rectangular and/or square. Preferably, the sling 102 is 2 m by 2 m, e.g., about 6.5 ft by 6.5 ft.

The sling 102 is foldable at the dashed central axis line. Accordingly, the sling 102 is divided into two portions: a first sling portion 106 and a second sling portion 106'. Preferably, the sling portions 106, 106' are halves of the sling 102. In other words, the sling 102 is bilaterally symmetrical along the central axis line. Thus, each sling portion 106 has a length of 2 m and a width of 1 m.

Sling handles 112*a-d* are coupled, e.g., sewn, to a length-wise edge of the first sling portion 106. Sling handles 112*a*'-d' are coupled, e.g., sewn, to a length-wise edge the second sling portion 106'. Additionally, sling handles 112*a*"-112*d*" are coupled, e.g., sewn, to the lower surface of the sling 102 along the central axis line (see FIG. 3D).

The upper surface of the second sling portion 106' has the sleeves 104*a-d* coupled, e.g., sewn, thereto. The sleeves 104*a-d* are quadrilaterals having central axis lines perpendicular to the central axis line of the sling 102.

The sides perpendicular to the central axis line of the sling 102 are permanently coupled to the second sling portion 106'. Accordingly, a space 114 is defined between each sleeve 104 and the second sling portion 106'.

Additionally, the sides adjacent the central axis line of the sling 102 and the side edge of the second sling portion 106' are left uncouple from the second sling portion 106'. Thus, the sleeve 104 is open-ended at those sides. A cushion 108 may be inserted into each space 114 through either of the open ends. Accordingly, the open ends are said to provide "lateral ingress" into and/or "lateral egress" of the cushion 108*a-d* between the sling 102 and the sleeve 104.

The sleeves 104*a-d* are coupled to the second sling portion 106' spaced axially apart from each. Therefore, when inserted between the sleeve 104 and the second sling portion 106', the cushions 104*a-d* are axially spaced apart as well. When a person lays on the cushion 108*a-d*, the space between cushions 108*a-d* advantageously provide relief from compression to parts of the person's body because compression of body parts over long periods may, in some cases, cause poor blood circulation and tissue sores. For example, in some cases, if a female laid prone on the cushions 108*a-d*, the breasts of the female would not be compressed. In some cases, if a male laid prone on the cushions 108*a-d*, the genital area of the male would not be compressed. In some case, if a person laid supine on the cushions 108*a-d*, the buttocks of the person would not be compressed.

Figure 2C:
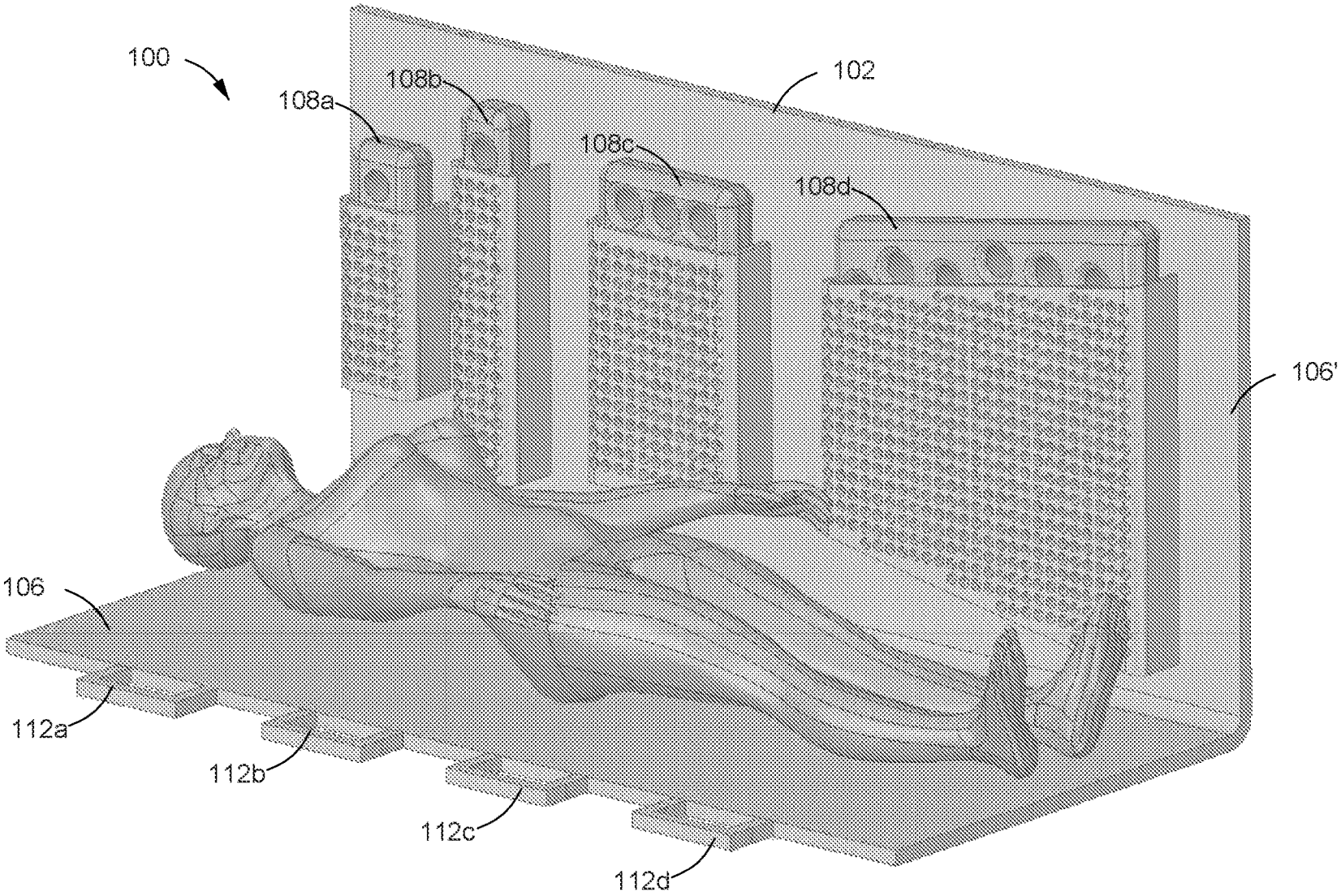
FIG. 2C illustrates the patient-turning assembly of FIG. 2B with the portion of the sling having the sleeves and cushions disposed in the sleeves lifted up at a right angle to the portion of the sling where the patient is lying.

FIG. 2C illustrates the sling 102 of FIG. 2B folded.

It can be seen that assembly 100 in FIGS. 1A and 1B and the assembly 100 in FIGS. 2A and 2B have sleeves 104 with different configurations. in FIGS. 1A and 1B, the flexible sling has a sling upper surface, a top edge which is close to where the patient's head will lie, and a bottom edge which is close to where the patient's feet will be placed. That assembly 100 also has a side edge which is parallel to the sides of the patient in a supine or prone position. That assembly 100 has a single flexible sleeve 104, which has an interior surface and an exterior surface. The sleeve 104 also has a first and second edges coupled to the sling upper surface, e.g., via stitching or some other coupling means. In FIGS. 1A and 1B, the edges of the sleeve 104 are linear outer edges of the sleeve, but the term "edge" when referring herein to any sleeve includes any points of contact between the sleeve and the sling surface, and can also include multiple points of contact between a lower surface of a cylindrically-shaped sleeve (not shown) that is co-planar with the upper surface of the sling, e.g., a sleeve having a shape and dimensions similar to a pillow-case with two open ends. As seen in FIGS. 1A and 1B, the first and second edges are spaced apart and parallel to one another, and the sleeve also has an opening extending between the first edge and the second edge such that one or more cushions 108*a*, 108*b*, 108*c*, 108*d* can be inserted through the opening and into the interior of the flexible sleeve 104, and the first and second edges of the single flexible sleeve 104 are parallel to the side edge of the flexible sling.

As described above, in FIGS. 2A and 2B, the flexible sling has a sling upper surface, a top edge which is close to where the patient's head will lie, and a bottom edge which is close to where the patient's feet will be placed. That assembly 100 also has a side edge which is parallel to the sides of the patient in a supine or prone position. That assembly 100 has multiple flexible sleeves 104*a-d*, each of which has an interior surface and an exterior surface. The sleeves 104*a-d* also each has a first and second edges coupled to the sling upper surface, e.g., via stitching or some other coupling means. As with the assemblies in FIGS. 1A and 1B, the edges of the sleeves 104*a-d* in FIGS. 2A and 2B are linear outer edges of the sleeve, but the term "edge" when referring herein to any sleeve includes any points of contact between the sleeve and the sling surface, and can also include multiple points of contact between a lower surface of a cylindrically-shaped sleeve (not shown) that is co-planar with the upper surface of the sling. As seen in FIGS. 2A and 2B, the first and second edges are spaced apart and parallel to one another, and each sleeve also has a side opening extending between the first edge and the second edge such that one or more cushions 108*a*, 108*b*, 108*c*, 108*d* can be inserted through the side opening and into the interior of each flexible sleeve 104, and the first and second edges of each of the multiple flexible sleeves 104*a-d* are parallel to the top or bottom edge of the flexible sling and for some of the flexible sleeves the edges are parallel to one of the side edges of the sling.

Figure 3A:
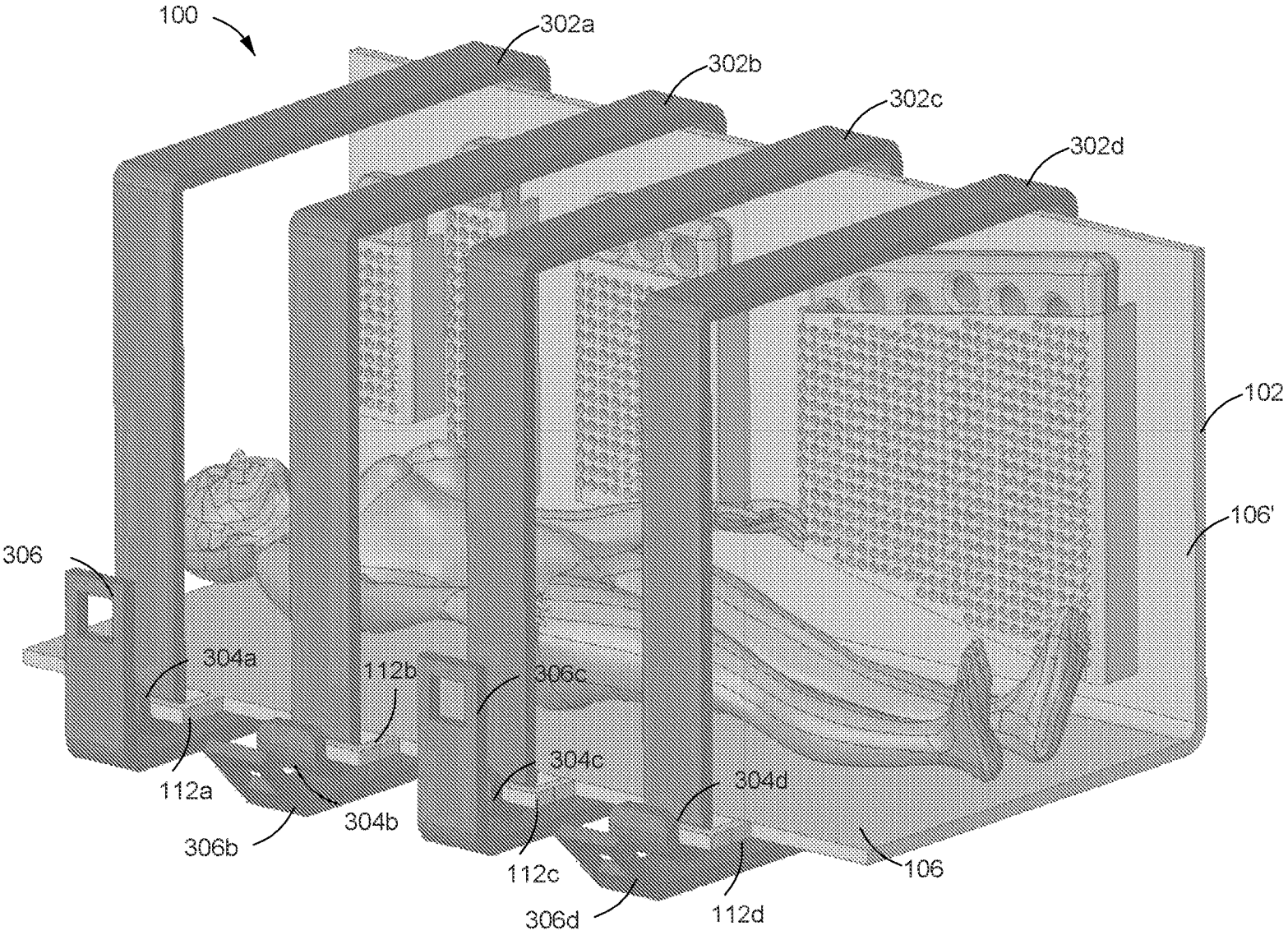
FIGS. 3A-F illustrate a sequence of configurations of the patient-turning assembly in which a patient is turned from a supine position to a prone position.
Figure 3B:
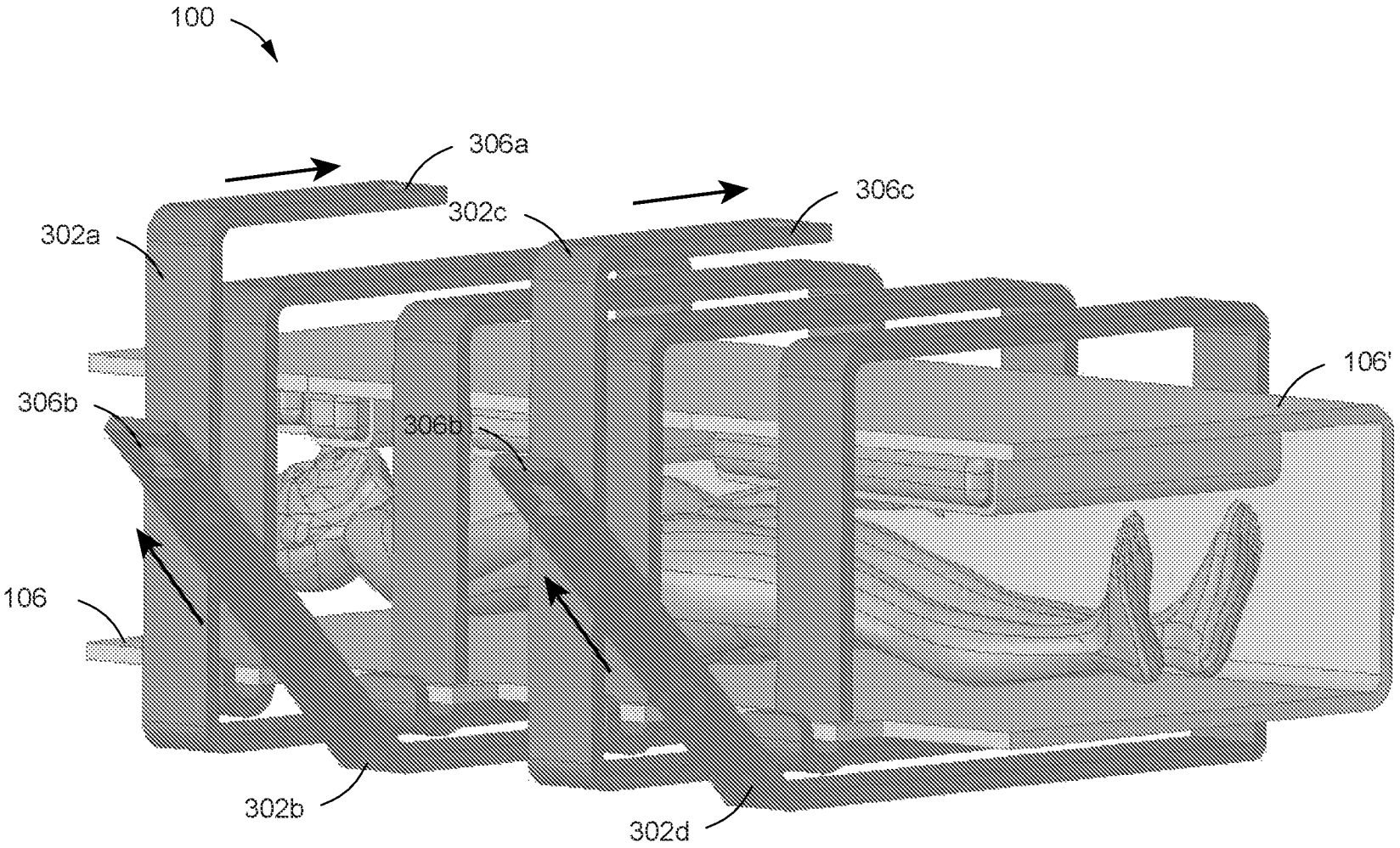
Figure 3C:
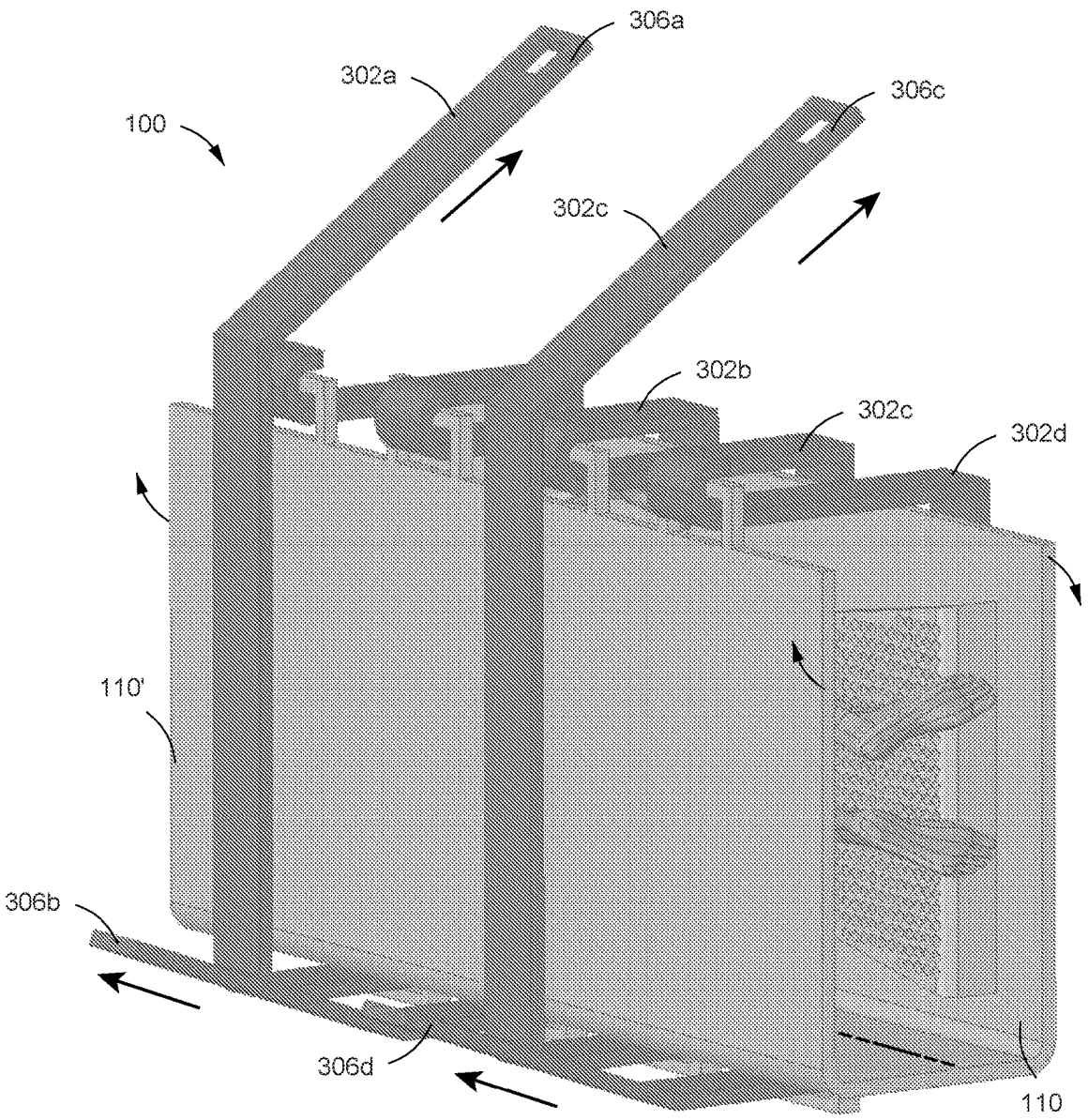

FIG. 3A illustrates a perspective view of a patient-turning assembly 100 having straps 302*a-d* disposed around a sling 102. The assembly 100 in FIG. 3A corresponds generally to the assembly 100 in FIGS. 2A and 2B. Each strap 302 has a first end and a second end. The first end has a hook 304 couple to a sling handle 112. The second end has a strap handle 306, e.g., for a person to pull.

Figure 3D:
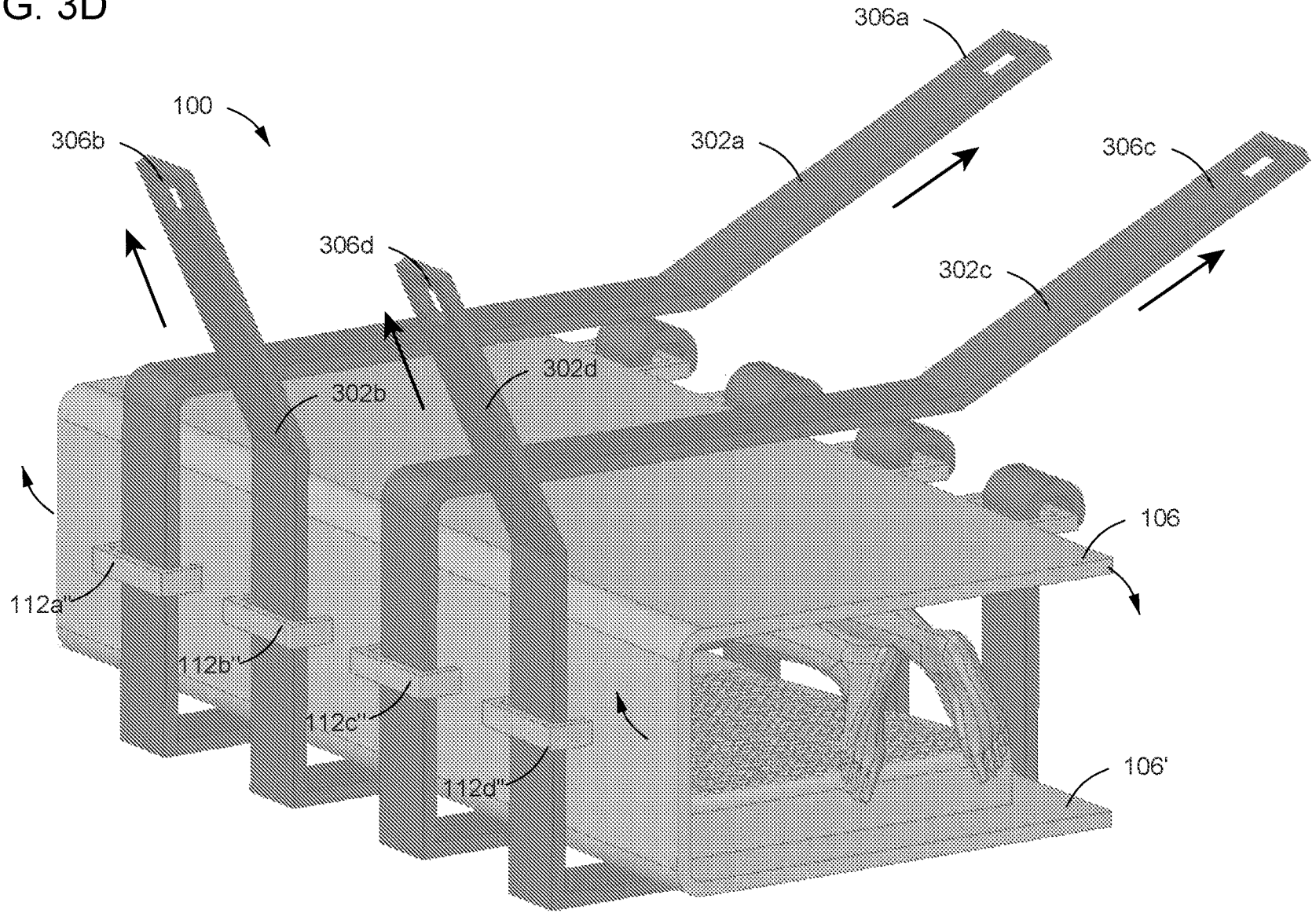

Each strap 302 is extended through a sling handle 112" (see FIG. 3D).

Each strap 302 may have a length equal or greater than the width of the sling 102. For example, if the sling 102 has dimensions of 2 m by 2 m, the strap 302 would have a length of at least 2 m.

FIGS. 3A-F illustrate a sequence of positions to have a patient-turning assembly 100 turn a patient. Two caregivers may perform the sequence to the patient.

Before having the patient lay on the sling 102, the caregivers may couple straps 302*a-d* to the lower surface of the sling 102. Thus, portions of straps 302*a-d* would be disposed beneath the sling 102 that is laid flat on a patient bed. In addition, the caregivers may insert cushions 108*a-d* between respective sleeves 104*a-d* and a second sling portion 106' of the sling 102. The cushions 108*a-d* may have varying lengths, widths, and/or thicknesses. Accordingly, the caregivers may adjust the position of the cushions 108*a-d* between their respective sleeves 104*a-d* and the sling 102 to accommodate patients of different heights and/or sizes. Friction between inner surfaces of the sleeves 104*a-d* and the respective cushions 108-*d* and friction between the upper surface of the sling 102 and the cushions 104*a-d* would hold the cushions 104*a-d* in place.

Referring to FIG. 3A, the patient initially lays supine on a first sling portion 106 of the sling 102.

Next, the caregivers may fold a second sling portion 106' over the patient, ensuring that the cushions 108*a-d* are comfortably position on the patient. Additionally, the caregivers may couple first ends of the strap having hooks 304*a-d* to respective sling handles 112*a-d*. Thus, the straps 302*a-d* may form loops around the sling 102 and patient.

Afterwards, a first caregiver (standing to the left of the patient) would pull second ends of the straps 304*a*, 304*a*, to the left of the patient. The first caregiver may pull second ends of the straps 304*a*, 304*a* at an angle, e.g., up and to the left, relative to the patient. A second caregiver (standing to the right of the patient) would pull second ends of the straps 302*b*, 304*d*, to the right of the patient. The second caregiver may pull second ends of the straps 302*b*, 304*d* at angle, e.g., up and to the right, relative to the patient. Additionally, As the straps 304*a-d* are pulled, they are tightened around the sling 102 and the patient. Accordingly, the cushions 108*a-d* would be retained snuggly against the person.

Although the second ends of the straps 302*a*, 302*c* are pulled left and the second ends of the straps 304*b*, 304*d* are pulled right, the hooks 304*a-d* are all pulled left. The pulled hooks 304*a-d* would pull the handles 112*a-d* left. The pulled handles 112*a-d* would pull the side edge of the first sling portion 106 left.

Additionally, as the first caregiver pulls the second ends of the strap 302*a*, 302*c*, upper surfaces of the strap 302*a*, 302*c* would push against the lower surface of the first sling portion 106. As the second caregiver pulls the second ends of the strap 302*b*, 302*d*, upper surfaces of the strap 302*b*, 302*d* would push against the lower surface of the second sling portion 106. Simultaneously pushing and pulling the sling portions 106, 106' would generate efficient force for two caregivers to roll the patient on the central axis of the sling 102 (see FIG. 3C).

Figure 3E:
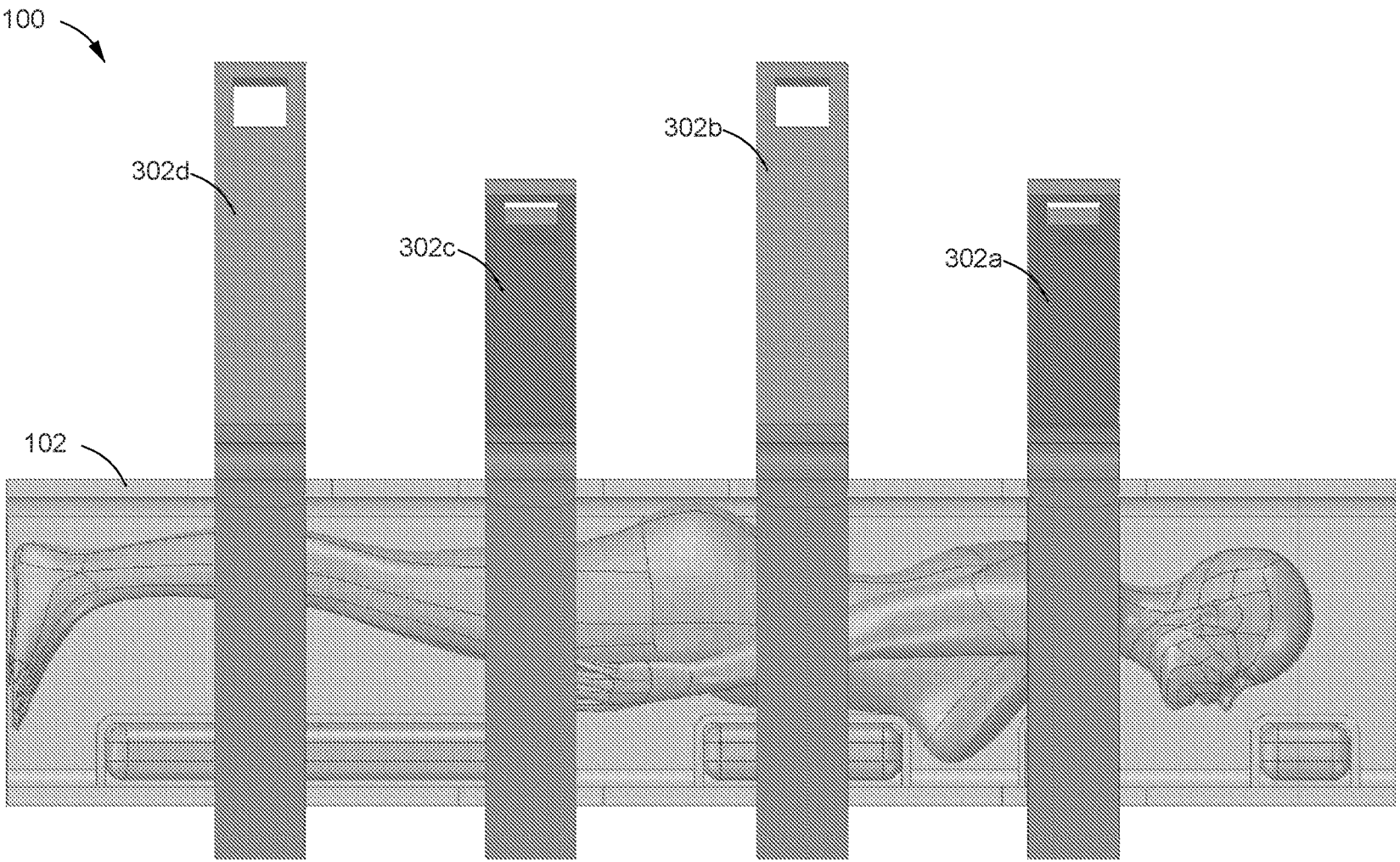
Figure 3F:
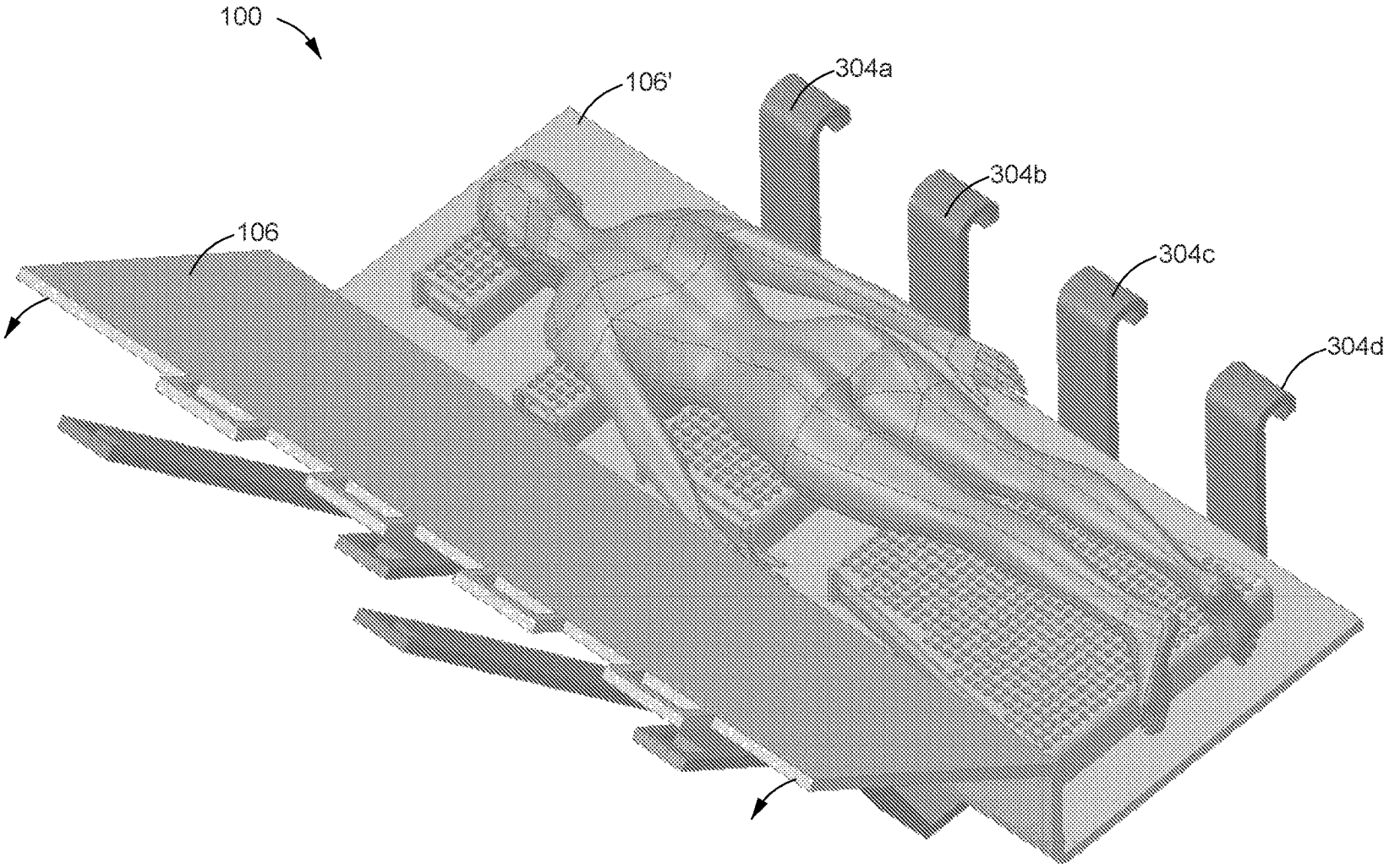

The caregivers may continue pulling the straps 302*a-d* until the patient is rolled to lay prone, e.g., facing-down, on the cushions 108*a-d*. The patient's legs, abdomen, shoulders, and head may rest on the cushions 108*a-d*, respectively, as shown in FIGS. 3E and 3F. The assemblies in FIGS. 3E and 3F are slightly different from the assemblies in the other drawings, in order to illustrate a specific embodiment in which the uppermost sleeve 104*a*, i.e., the sleeve closest to the patient's head, is sized and positioned so that, unlike the assemblies shown in the other drawings, the patient's forehead abuts against the outside surface of that uppermost sleeve 104*a* when the patient is in the prone position, and her mouth and nose are positioned in the gap between that sleeve 104*a* and the adjacent sleeve 104*b*. The other drawings show an exemplary arrangement of sleeves and illustration of how a patient might be juxtaposed on the assembly without the specific arrangement shown in FIGS. 3E and 3F.

The first sling portion 106 is now positioned over the patent. The caregivers may uncouple the hooks 304*a-d* from the handles 112*a-d*. Then, the caregivers may unfold the first sling portion 106 away from the patient.

While the patient is laying prone on the cushions 118, the caregivers may couple hoses (not shown) to the cushions 108*a-d*. The hoses may be coupled to a sequential compression device (SCD) (not shown). The SCD may regularly pump fluid into and/or remove fluid from each cushion 108. The fluid may be air or liquid, e.g., water. The movement of fluid in or out of each cushion 108 may respectively inflate or deflate the cushion 108. Inflation and/or deflation of the cushion 108 may assist in changing pressure against the patient's skin and tissue resting on the cushion 108. Changing pressure against the skin and tissue may help to improve blood circulation and may reduce risks of bed sores.

What is claimed as the invention is:

1. A method of turning a patient, comprising (1) providing a patient-turning assembly, comprising:

a flexible sling having a sling upper surface, a top edge, a bottom edge, and a side edge; and either one flexible sleeve or multiple parallel flexible sleeves, each flexible sleeve having:

(a) an interior surface and an exterior surface;

(b) a first edge coupled to the sling upper surface;

(c) a second edge coupled to the sling upper surface, wherein the first edge and the second edge are spaced apart and parallel to one another; and (d) an opening extending between the first edge and the second edge such that a cushion can be inserted through the opening and into the interior of each flexible sleeve, wherein:

(i) the first and second edges of the one flexible sleeve are parallel to the side edge of the flexible sling; and (ii) the first and second edges of each of the multiple flexible sleeves are parallel to the bottom edge or the top edge of the flexible sling and each of the multiple flexible sleeves are separated by a gap; (2) laying the patient on the sling beside either the one flexible sleeve or the multiple parallel flexible sleeves; (3) disposing either the one flexible sleeve or the multiple parallel flexible sleeves over the patient; and (4) turning the patient onto either the one flexible sleeve or the multiple parallel flexible sleeves.

2. The method of claim 1, wherein the one or more flexible sleeves comprises an elastic material.

3. The method of claim 1, wherein the one or more flexible sleeves comprises an elastic mesh material.

4. The method of claim 1, wherein the sling upper surface comprises: a first upper surface having a first top edge, a first bottom edge, and a first side edge, wherein the maximum distance from the first top edge to the first bottom edge defines the length of the first upper surface; and a second upper surface having a second top edge, a second bottom edge, and a second side edge, wherein the maximum distance from the second top edge to the second bottom edge defines the length of the second upper surface, and wherein: the second upper surface adjoins the first upper surface along a dividing line that is shared by both the first upper surface and the second upper surface; the maximum distance from the first side edge to the dividing line defines the width of the first upper surface, the maximum distance from the second side edge to the dividing line defines the width of the second upper surface; and wherein the width of the first upper surface and the width of the second upper surface are the same.

5. The method of claim 4, wherein the one or more flexible sleeves is coupled to the first upper surface of the sling such that both the first edge of the one flexible sleeve and the second edge of the one flexible sleeve are coupled to the first upper surface and are parallel to the first side edge of the sling upper surface, or are parallel to the second side edge of the sling upper surface, or are parallel to both the first side edge and the second side edge of the sling upper surface.

6. The method of claim 4, wherein the one or more flexible sleeves is coupled to the first upper surface of the sling such that both the first edge of the one flexible sleeve and the second edge of the one flexible sleeve are coupled to the first upper surface and are perpendicular to the first side edge of the sling upper surface, or are perpendicular to the second side edge of the sling upper surface, or are perpendicular to both the first side edge and the second side edge of the sling upper surface.

7. The method of claim 4, comprising two or more flexible sleeves each having a first edge and a second edge, wherein each of the two or more flexible sleeves is coupled to the first upper surface of the sling such that both the first edge of each flexible sleeve and the second edge of each flexible sleeve are coupled to the first upper surface and are parallel to the first side edge of the sling upper surface, or are parallel to the second side edge of the sling upper surface, or are parallel to both the first side edge and the second side edge of the sling upper surface.

8. The method of claim 4, comprising two or more flexible sleeves each having a first edge and a second edge, wherein each of the two or more flexible sleeves is coupled to at least a portion of the first and second upper surfaces of the sling such that both the first edge of each flexible sleeve and the second edge of each flexible sleeve are coupled to the first and second upper surfaces and are perpendicular to the first side edge of the sling upper surface, or are perpendicular to the second side edge of the sling upper surface, or are perpendicular to both the first side edge and the second side edge of the sling upper surface.

9. The method of claim 1, wherein each sleeve comprises a fabric.

10. The method of claim 1, wherein each sleeve comprises a portion that is water-resistant.

11. The method of claim 1, wherein each sleeve has two openings on opposite ends of the sleeve.

12. The method of claim 1, wherein the one or more sleeves has at least one side that extends parallel to the longest side of the sling.

13. The method of claim 1, additionally comprising a strap that is capable of encircling the sling while a person is disposed on the sling.

14. The method of claim 13, wherein the strap has a portion coupled to a lower surface of the sling.

15. The method of claim 14, wherein the strap portion includes a hook capable of being coupled to the sling.

16. The method of claim 14, wherein the strap portion includes a hook coupled to an edge of the sling.

17. The method of claim 13, additionally comprising a first strap portion wherein the sling has a handle capable of being coupled to the first strap portion.

18. The method of claim 13, wherein the strap has a first strap portion and a second strap portion, wherein the first strap portion is capable of pulling a portion of the sling and the second strap portion is capable of pushing the portion of the sling.

19. The method of claim 13, wherein the sling has a sling portion with a lower surface and wherein a portion of the strap is coupled to the lower surface of the sling.

20. The method of claim 1, comprising one or more sleeves, wherein each of the one or more sleeves has an outer surface and an inner surface, and additionally comprising a cushion capable of being disposed between at least part of the upper surface of the sling and the inner surface of the at least one of the one or more sleeves.

* * * * *